US006311670B1

(12) United States Patent
Constancis

(10) Patent No.: US 6,311,670 B1
(45) Date of Patent: Nov. 6, 2001

(54) METHOD FOR CORRECTING AN INTERNAL COMBUSTION ENGINE TORQUE JERKS

(75) Inventor: Pierre Constancis, Poissy (FR)

(73) Assignee: Renault, Boulogne Billancourt (FR)

( * ) Notice: Subject to any disclaimer, the term of this patent is extended or adjusted under 35 U.S.C. 154(b) by 0 days.

(21) Appl. No.: 09/463,406

(22) PCT Filed: Jul. 31, 1998

(86) PCT No.: PCT/FR98/01706

§ 371 Date: Jun. 22, 2000

§ 102(e) Date: Jun. 22, 2000

(87) PCT Pub. No.: WO99/06685

PCT Pub. Date: Feb. 11, 1999

(30) Foreign Application Priority Data

Aug. 1, 1997 (FR) ..... 97 09856

(51) Int. Cl.[7] ..... F02D 31/00
(52) U.S. Cl. ..... 123/352; 123/361
(58) Field of Search ..... 123/352, 436, 123/361, 399

(56) References Cited

U.S. PATENT DOCUMENTS 5,036,814 * 8/1991 Osawa et al. ..... 123/352
5,043,647 * 8/1991 Flaig et al. ..... 123/352
5,532,929 * 7/1996 Hattori et al. ..... 123/361
5,546,903 * 8/1996 Satou et al. ..... 123/361
5,642,709 * 7/1997 Ozaki et al. ..... 123/361
5,738,070 * 4/1998 Danaldson et al. ..... 123/352
5,845,619 * 12/1998 Reichlinger ..... 123/361
5,932,896 * 11/1998 Phipps ..... 123/352
5,979,402 * 11/1999 Melbourne ..... 123/352
5,992,384 * 11/1999 Bauer et al. ..... 123/361
6,052,644 * 4/2000 Muralami et al. ..... 123/361

FOREIGN PATENT DOCUMENTS 0-155-993 10/1985 (EP) .
0-534-813 3/1993 (EP) .
0-561-382 9/1993 (EP) .
0-595-505 5/1994 (EP) .
2-042-772 9/1980 (GB) .

* cited by examiner

*Primary Examiner*—John Kwon
(74) *Attorney, Agent, or Firm*—Oblon, Spivak, McClelland, Maier & Neustadt, P.C.

(57) ABSTRACT

A method for correcting fuel injection internal combustion engine torque jerks including an electronic engine control system which determines, according to engine operating conditions, engine control parameter values, and such that at least one control parameter value is corrected in response to the engine torque oscillations. The control parameter value is computed on the basis of an accelerator pedal position, and a correction is determined to be applied to the control parameter by filtering an engine shaft rotation speed.

7 Claims, 2 Drawing Sheets

METHOD FOR CORRECTING AN INTERNAL COMBUSTION ENGINE TORQUE JERKS

BACKGROUND OF THE INVENTION

1. Field of the Invention

The present invention relates to a process for correction of control parameters of an internal combustion engine of a motor vehicle in order to eliminate the potential phenomena known as torque jolts that can occur during particular vehicle operating conditions.

2. Discussion of the Background

It is known that, under certain operating conditions of a motor vehicle equipped with an internal combustion engine, especially in transition phases (such as hard acceleration, etc.), there occur phenomena of oscillations of the torque transmitted to the vehicle wheels, or in other words jolts, these jolts then affecting the comfort of the vehicle passengers.

These oscillations originate mainly from the kinematic chain connecting the engine to the tire/road interface. In fact, the mechanical energy at the end of the crankshaft is transmitted to the wheels by a transmission system which traditionally comprises a clutch, a gearbox and a differential, each of these elements having its own damping and stiffness. As a result, any abrupt variation of the engine torque in the crankshaft region is transmitted to the wheels as oscillations whose amplitude will depend on the characteristics of the transmission system.

Numerous methods for remedying these torque oscillations have been conceived. Thus it is known from the prior art, especially from European Patent Application EP A 461504 and World Patent Application WO A 90/06441, that the torque of an engine can be regulated in such a way as to reduce or suppress the sensation of torque oscillations experienced by the vehicle operator.

According to this known prior art, the engine control parameters, or in other words the injection time or the ignition advance, are corrected to eliminate the oscillations by performing monitoring of the engine torque at the wheels and by correcting in the control loop the value of the chosen control parameter or parameters as a function of the amplitude of the detected oscillations.

Such methods nevertheless suffer from certain disadvantages, especially that of causing increased pollutant emission, since the main object of the corrections made is to reduce the engine torque by lowering combustion quality.

In addition, the known methods are limited to correcting the consequences of an abrupt torque variation after its occurrence has been recorded and identified, without acting on the cause thereof, or in other words abrupt variation of the air flow.

SUMMARY OF THE INVENTION

The object of the present invention is therefore to propose a process for correction of the control parameters of an internal combustion engine in order to eliminate the torque jolts, which process remedies the disadvantages of the prior art while being particularly simple to implement.

The process according to the invention for correction of torque jolts relates more particularly to an internal combustion engine provided with an electronic engine control system which determines the values of engine control parameters as a function of engine operating conditions. This process is of the type by which at least one control parameter ($\alpha$PAP) is corrected in response to oscillations of the engine torque.

According to the invention, the process for correction of torque jolts is characterized in that it comprises the following stages:

calculation of the value of the said control parameter directly as a function of accelerator pedal position;

determination of the correction to be applied to this control parameter by filtering of the speed of revolution of the engine shaft.

Thus the process according to the present invention deals directly with the primary source of torque jolts, or in other words the abrupt variations of the accelerator pedal, which ordinarily generate corresponding abrupt variations of the air flow or of the fuel flow and thus abrupt variations of torque. By eliminating the perturbations at the source and by taking into account the evolution of engine speed, better compensation for torque jolts is achieved.

According to another characteristic of the process according to the invention for correction of torque jolts, the control parameter corrected in response to oscillations of the engine torque is the opening position of the gas throttle.

According to another characteristic of the process according to the invention for correction of torque jolts, calculation of the value of the said control parameter as a function of the accelerator pedal position is achieved on the basis of an adapted progressive adjustment formula.

According to another characteristic of the process according to the invention for correction of torque jolts, the progressive adjustment formula depends on values of the characteristic parameters of engine operation and/or on the rate of depression of the accelerator pedal.

According to another characteristic of the process according to the invention for correction of torque jolts, filtering of the existing engine speed is performed by a filter of the filtered second derivative type with variable gain and time constant.

BRIEF DESCRIPTION OF THE DRAWINGS

The objectives, aspects and advantages of the present invention will be better understood from the description given hereinafter of an embodiment of the invention applied to a four-stroke engine with controlled ignition, this embodiment being described by way of nonlimitative example with reference to the attached drawing, wherein:

FIG. 1 illustrates the configuration of an engine control system in which there is implemented the process according to the present invention for correction of torque jolts. Only the constitutive portions necessary to understanding of the invention are shown.

DESCRIPTION OF THE PREFERRED EMBODIMENTS

Figure 1:
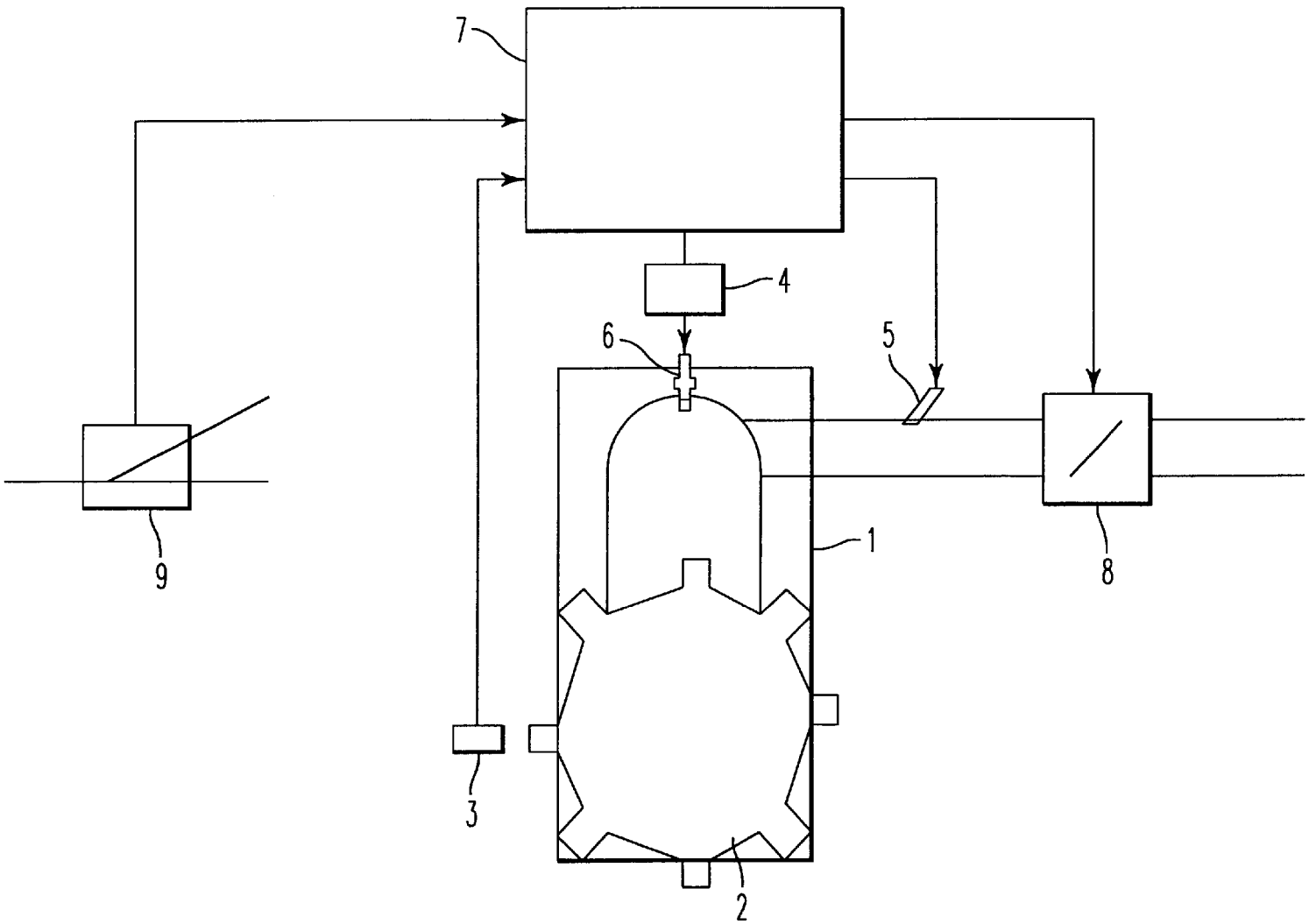
FIG. 1 is a structural diagram in partial section of the engine and its engine control device, in which there is integrated the process according to the present invention.

Internal combustion engine 1 of the four-stroke type with controlled-ignition and straight cylinder arrangement is equipped with a multipoint injection device by means of which each cylinder is supplied with fuel by a specific electric injector 5. Opening of each electric injector 5 is controlled by an electronic engine control system 7, which determines, as a function of the engine operating conditions, the quantity of fuel injected or the duration Ti of injection in an injection system of the pressure-time type, as well as the phasing of injection during the cycle.

The combustion air supply is controlled by a gas throttle 8. This gas throttle, of the motorized type, is directed by electronic engine control system 7 as a function of the position of accelerator pedal 9, which is transmitted by an appropriate displacement sensor. Thus the engine control system transforms the angle αPED of depression of the accelerator pedal into an angle αPAP of opening of the gas throttle on the basis of an adapted table.

This table of correspondence between the angle αPED of depression of the accelerator pedal and the angle αPAP of opening of the gas throttle can be more or less complex and can take into account the engine operating point in particular (pressure-speed plot, etc.).

According to the invention, this table introduces an adapted progressive adjustment formula between the depression of the accelerator pedal and the opening of the gas throttle, which progressive adjustment formula has the effect of limiting the excessively abrupt variations of engine load and therefore of suppressing at the source a certain number of perturbations which cause torque jolts. As an example, this progressive adjustment formula can take into account the rate αPED' of depression of accelerator pedal 9 (αPED'= dαPED/dt).

Engine control system 7 also controls the instant of firing of each spark plug 6 by means of ignition power module 4, which controls the operation of the coil, high voltage then being sent to each spark plug 6 via a distributor, which is not shown. Ordinarily, a spark plug is caused to fire before the piston arrives at the explosion top dead center. This advance Av, which can evolve from a few degrees to several tens of degrees of crankshaft angle, is determined by the engine control system as a function of the engine operating conditions.

Engine control system 7 ordinarily comprises a computer provided with a CPU, random-access memory (RAM), read-only memory (ROM), analog-to-digital converters (A/D) and different input and output interfaces. This engine control system receives input signals, performs operations and generates output signals destined in particular for injectors 5 and ignition power module 4.

Among the input signals of engine control system 7 there are therefore included the angle αPED of depression of the accelerator pedal and the signals transmitted by a crankshaft sensor 3 for the purpose, in particular, of synchronizing the instants of injection and ignition with engine operation.

This sensor 3, of the variable reluctance type, for example, which is mounted in fixed condition on the engine frame, is associated with a measuring ring 2 integral with the flywheel, and is provided with a certain number of marks or teeth. Sensor 3 is capable of delivering a signal representative of the passage of teeth supported by the ring, and more particularly of the rate of passage of these teeth, or in other words is representative of the instantaneous speed of revolution of the flywheel, also known as instantaneous speed of revolution of the engine and denoted by the symbol N. The value of speed of revolution N is used to determine the calculation of the injection time and the instant of ignition according to predetermined strategies.

Figure 2:
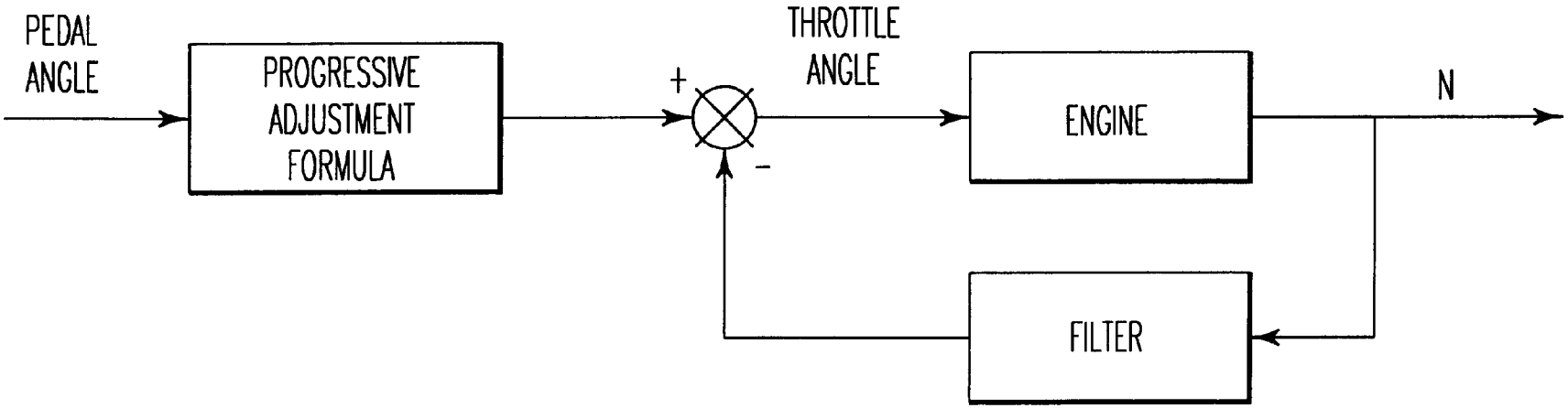
FIG. 2 is a block diagram detailing the different stages of the process according to the invention.

FIG. 2 describes a block diagram of the process for correction of torque jolts as a supplement to the progressive adjustment formula introduced between αPED and αPAP.

According to this process for correction of torque jolts, engine control parameter αPAP is corrected by filtering of engine speed N. The regulating loop defined in this way is applied continuously to the value αPAP, thus making it possible to eliminate the engine torque oscillations.

This regulating loop is obtained simply by virtue of digital filtering of the type which, for example, calculates a filtered second derivative of the continuous transfer function given by the formula $S^2/(\omega^2+2\omega\xi+s^2)$, where s is the Laplace variable, ω the angular frequency and ξ the damping thereof.

For a given engine, the characteristic values of the filter are obtained experimentally, for example, by measurement on the test bench. These values are stored in the corresponding memories of engine control system 7 in the classical form of tables or plots.

The value of the angle αPAP of opening of the gas throttle actually selected by electronic engine control system 7 is therefore the value αPAP obtained from the value αPED according to the chosen progressive adjustment formula, to which there is therefore added the algebraic correction value obtained according to the filtering process described in the foregoing.

By means of the process according to the invention, therefore, it is possible to regulate the value of the engine torque by continuously adapting the value of the angle αPAP, thus making it possible to eliminate any torque oscillations regardless of the operating level of the engine. The process therefore makes it possible to suppress any sensations of torque jolts that the passenger(s) may experience, without nevertheless diminishing the vehicle performance.

Compared with an action on another control parameter such as injection time or ignition advance, the action on control parameter αPAP has the advantage that it does not reduce the quality of engine operation, especially its fuel consumption and its pollutant emission. In addition, such an action on αPAP has a very short response time, since it is possible, especially by virtue of the introduced progressive adjustment formula, to suppress the very source of certain misfires.

The great simplicity of the process developed here permits its implementation even in computers of limited capacity. In addition, the small number of values to be calibrated makes it possible to shorten the time for fine tuning of a vehicle to a minimum.

Of course, the invention is by no means limited to the described and illustrated embodiment, which was given merely by way of example.

To the contrary, the invention comprises all the technical equivalents of the described means as well as combinations thereof if such are made within the spirit of the invention.

Thus, the filtering described above can be replaced by any other appropriate type of filtering and, for example, by two successive filtering steps applied to measurement of the instantaneous speed of revolution N of the engine, such as that described in French Patent Application No. 93/14293 filed by the Applicant.

Thus the system for correction of torque jolts by correction of the angle αPAP of opening of the gas throttle can be achieved in diverse forms:

- either with analog electronic components, for which the differentiators, multipliers and other filters are constructed by means of operational amplifiers;
- or with digital electronic components, which would achieve the function by hard-wired logic;
- or by a signal-processing algorithm, loaded in the form of a logical module representing a logical engine control system for operating the microcontroller of an electronic computer;

or even by a specific (custom) chip, whose hardware and software resources will have been optimized to achieve the functions according to the invention; such a chip may or may not be microprogrammable and may be encapsulated separately or comprise all or part of a coprocessor implanted in a microcontroller or microprocessor, etc.

What is claimed is:

1. A method for correcting torque jolts of an engine, comprising the steps of:

calculating a position of a gas throttle as a function of an accelerator position based on an adapted progressive adjustment formula;

filtering an engine speed for said engine; and correcting said position of said gas throttle based on said filtering so as to correct for torque jolts of said engine, wherein said adapted progressive adjustment formula is based on at least one of characteristic values of engine operational parameters and a rate of change of said accelerator position.

2. A method according to claim 1, wherein said accelerator position is an accelerator pedal position.

3. A method according to claim 1, wherein said filtering comprises:

calculating a filtered second derivative of an engine continuous transfer function.

4. A method according to claim 1, wherein said adapted progressive adjustment formula is based on a rate of change of said accelerator position.

5. A method for correcting torque jolts of an engine, comprising the steps of:

calculating a position of a gas throttle as a function of an accelerator position;

filtering an engine speed for said engine based on a second derivative of an engine transfer function; and correcting said position of said gas throttle based on said filtering, wherein calculating said position of said gas throttle is based on an adapted progressive adjustment formula, and said adapted progressive adjustment formula is based on at least one of characteristic values of engine operational parameters and a rate of change of said accelerator position.

6. A method according to claim 5, wherein said accelerator position is an accelerator pedal position.

7. A method according to claim 5, wherein said adapted progressive adjustment formula is based on a rate of change of said accelerator position.

* * * * *